US012612728B2

(12) United States Patent
Zheng et al.

(10) Patent No.: US 12,612,728 B2
(45) Date of Patent: Apr. 28, 2026

(54) STEAM BRUSH WITH CLAMPING AND IRONING STRUCTURE AND STEAMING IRONING MACHINE

(71) Applicant: Tsann Kuen (Zhangzhou) Enterprise Co., Ltd., Zhangzhou City (CN)

(72) Inventors: Zhenxing Zheng, Zhangzhou City (CN); Ronghuang Chen, Zhangzhou City (CN); Longhai Zhou, Zhangzhou City (CN)

(73) Assignee: Tsann Kuen (Zhangzhou) Enterprise Co., Ltd, Zhangzhou City (CN)

( * ) Notice: Subject to any disclaimer, the term of this patent is extended or adjusted under 35 U.S.C. 154(b) by 6 days.

(21) Appl. No.: 18/810,715

(22) Filed: Aug. 21, 2024

(65) Prior Publication Data

US 2025/0075420 A1 Mar. 6, 2025

(30) Foreign Application Priority Data

Sep. 6, 2023 (CN) ..... 202322417956.9
Nov. 3, 2023 (CN) ..... 202311462194.2

(51) Int. Cl.
*D06F 71/34* (2006.01)
*D06F 71/04* (2006.01)
*D06F 71/36* (2006.01)

(52) U.S. Cl.
CPC ..... *D06F 71/34* (2013.01); *D06F 71/04* (2013.01); *D06F 71/36* (2013.01)

(58) Field of Classification Search
CPC ..... D06F 71/34; D06F 71/04; D06F 71/36; D06F 71/18; D06F 71/08; D06F 75/30; D06F 75/34
See application file for complete search history.

(56) References Cited

U.S. PATENT DOCUMENTS

| | | | | |
|---|---|---|---|---|
| 2,308,941 | A * | 1/1943 | Stevenson | D06F 75/40 38/79 |
| 4,817,309 | A * | 4/1989 | Frank | D06F 75/30 38/15 |
| 7,188,442 | B2 * | 3/2007 | Fernandez | D06F 75/40 38/81 |
| 11,085,146 | B2 * | 8/2021 | Yao | D06F 59/02 |
| 11,168,439 | B1 * | 11/2021 | Toll | D06F 75/34 |
| 2005/0278988 | A1 * | 12/2005 | Fernandez | D06F 75/14 38/81 |
| 2010/0199528 | A1 * | 8/2010 | Fabrikant | D06F 71/32 38/77.8 |
| 2015/0191865 | A1 * | 7/2015 | Bishop | D06F 75/18 219/230 |

FOREIGN PATENT DOCUMENTS

CN 201162146 Y 12/2008

* cited by examiner

*Primary Examiner* — Uyen T Nguyen
(74) *Attorney, Agent, or Firm* — Cooper Legal Group, LLC

(57) ABSTRACT

The disclosure provides a steam brush with a clamping and ironing structure and a steaming ironing machine. The steam brush with a clamping and ironing structure includes a steam brush body and a plate clamp. A material of the plate clamp is a thermally conductive material. The plate clamp is hingedly connected to the steam brush body and forms a clamping and ironing structure with an ironing surface. When ironing a garment, the plate clamp can obtain heat from an ironing panel, such that both sides of a garment clamped between the ironing panel and the plate clamp can be ironed, thereby achieving a better ironing effect.

16 Claims, 5 Drawing Sheets

STEAM BRUSH WITH CLAMPING AND IRONING STRUCTURE AND STEAMING IRONING MACHINE

CROSS-REFERENCE TO RELATED APPLICATIONS

This application claims priority to Chinese Patent Application 202311462194.2, filed on Nov. 3, 2023, and Chinese Patent Application 202322417956.9, filed on Sep. 6, 2023, which are incorporated herein by reference.

TECHNICAL FIELD

The disclosure relates to the field of steaming ironing machines, and in particular to a steam brush with a clamping and ironing structure and a steaming ironing machine.

BACKGROUND

Steam ironing of garments has the characteristics of high ironing speed, high ironing efficiency, and no influence on the surface and internal texture of the garments. Therefore, steaming ironing machines are widely used.

Publication No. CN201162146Y discloses a steam jet for a hanging ironing machine, which realizes a clamping and ironing structure by arranging a garment clamping board opposite to the ironing and brushing board. The garment clamping board is arranged to clamp the garment to one side of the ironing and brushing board, such that the garment hanging on a hanger can be ironed when there is no support. The garment clamping board (plate clamp) is mostly made of a high-temperature-resistant plastic material. However, this clamping and ironing device does not have a more significant ironing effect.

SUMMARY

Therefore, in order to alleviate the above problems and achieve a better ironing effect, the disclosure provides a steam brush with a clamping and ironing structure and a steaming ironing machine.

In order to achieve the above objective, the disclosure provides the following technical solution:

A steam brush with a clamping and ironing structure includes a steam brush body and a plate clamp. The steam brush body has an ironing surface and steam outlets provided on the ironing surface. The plate clamp is hingedly connected to the steam brush body and forms the clamping and ironing structure with the ironing surface. A material of the plate clamp is a thermally conductive material. The plate clamp is provided with a connecting arm. The connecting arm is inserted into the steam brush body via the ironing surface, and the connecting arm is hingedly connected to the steam brush body by means of a hinge shaft, thereby realizing a hinged connection of the plate clamp. The steam brush body is provided with a driving portion. The driving portion is a press assembly provided with a press member, and the driving portion acts on the connecting arm. A downward press of the press member drives the connecting arm to swing with the hinge shaft as a pivot, thereby driving the plate clamp to open.

Further, the material of the plate clamp is a metal material.

Further, the metal material is aluminum or aluminum alloy or stainless steel or iron or powder metallurgy.

Further, the steam brush body is provided with an elastic return member. The elastic return member acts on the connecting arm of the plate clamp to drive the plate clamp to close.

Further, the elastic return member is a double torsion spring, and torsion spring sections at two ends of the double torsion spring are respectively sleeved on two ends of the hinge shaft. A middle arm and end arms of the double torsion spring respectively abut against the steam brush body and the connecting arm to drive the plate clamp to close.

Further, the press assembly further includes a slider and a slider housing. The slider housing is fixed on the steam brush body. The slider is slidable up and down and is assembled on the slider housing. A bottom of the slider is provided with an inclined elongated hole. The connecting arm is assembled with a slider rotating shaft. The slider rotating shaft runs through the inclined elongated hole. The press member is connected to a top of the slider. The downward press of the press member drives the slider to move downward, thereby driving the connecting arm to swing with the hinge shaft as the pivot.

Further, the steam brush body includes a housing, and the press member is arranged at a top of the housing away from the plate clamp.

Further, the steam brush body includes an electric heating plate, an insulation base, and a heat insulation shield. A bottom surface of the electric heating plate is the ironing surface. The steam outlets are provided on the electric heating plate. The electric heating plate is provided with a steam jet communicated with the steam outlets. The insulation base is a heat insulation base board. The insulation base covers the electric heating plate and is provided with an avoidance window for avoiding the steam jet. The heat insulation shield covers the steam jet and is fixed on the insulation base.

Further, an outer edge of the ironing surface of the steam brush body is depressed inward to form a depression, and the depression and the ironing surface are connected through an inclined transition surface. The plate clamp is a frame structure with a hollowed middle part. When in a closed position, the plate clamp is accommodated in the depression, and an inner wall of the plate clamp is an inclined inner wall corresponding to the inclined transition surface.

A steaming ironing machine includes at least the above steam brush with a clamping and ironing structure.

The technical solution provided by the disclosure has the following beneficial effects:

By setting the material of the plate clamp to be the thermally conductive material and preferably the metal material with good thermal conduction effect, when ironing a garment, the plate clamp can obtain heat from the ironing panel (i.e., the component forming the ironing surface), such that both sides of the garment clamped between the ironing panel and the plate clamp can be ironed, thereby achieving a better ironing effect.

DESCRIPTION OF EMBODIMENTS

Figure 1:
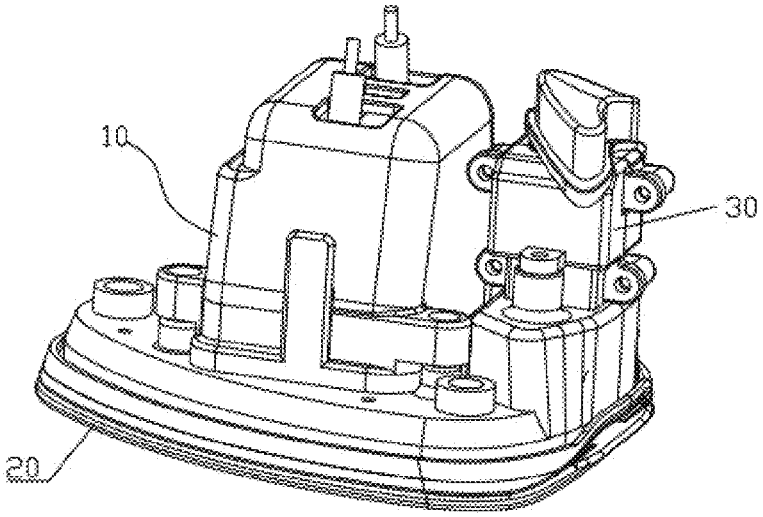
FIG. 1 is a schematic view I showing the appearance of a steam brush with a clamping and ironing structure in an example.
Figure 2:
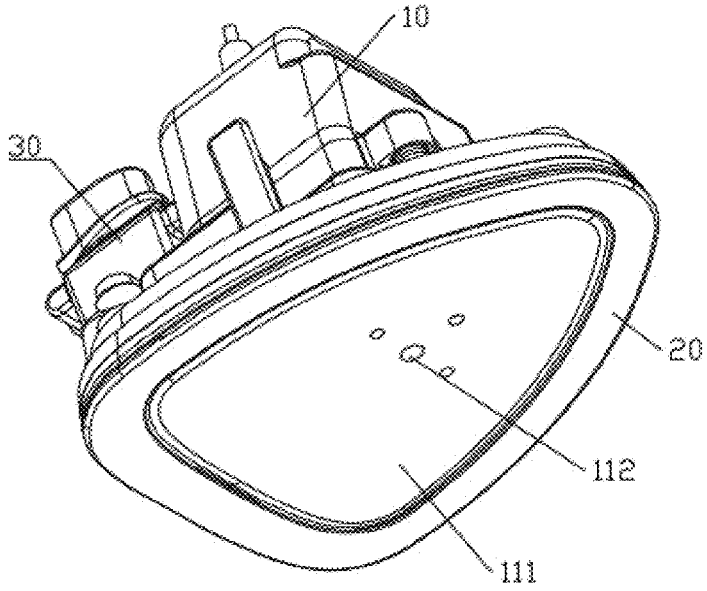
FIG. 2 is a schematic view II showing the appearance of the steam brush with a clamping and ironing structure in an example.
Figure 3:
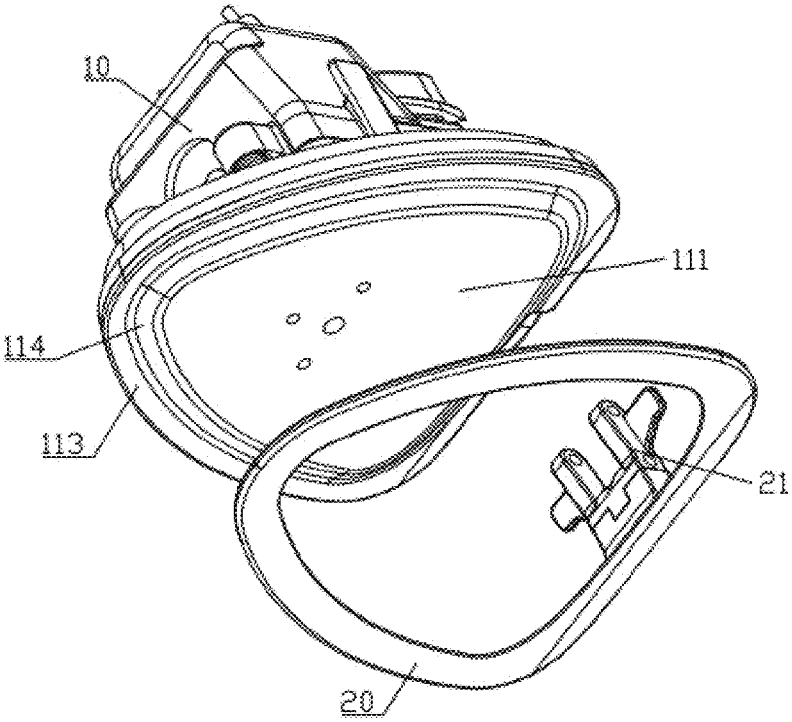
FIG. 3 is a schematic partial structural exploded view of the steam brush with a clamping and ironing structure in an example.
Figure 4:
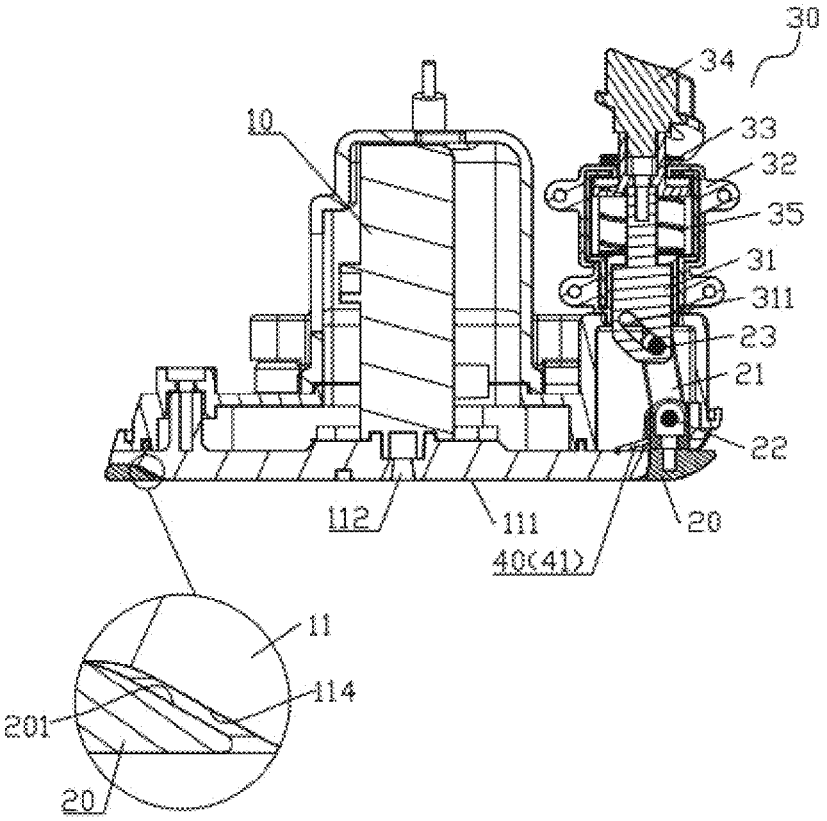
FIG. 4 is a sectional view of the steam brush with a clamping and ironing structure in an example.
Figure 5:
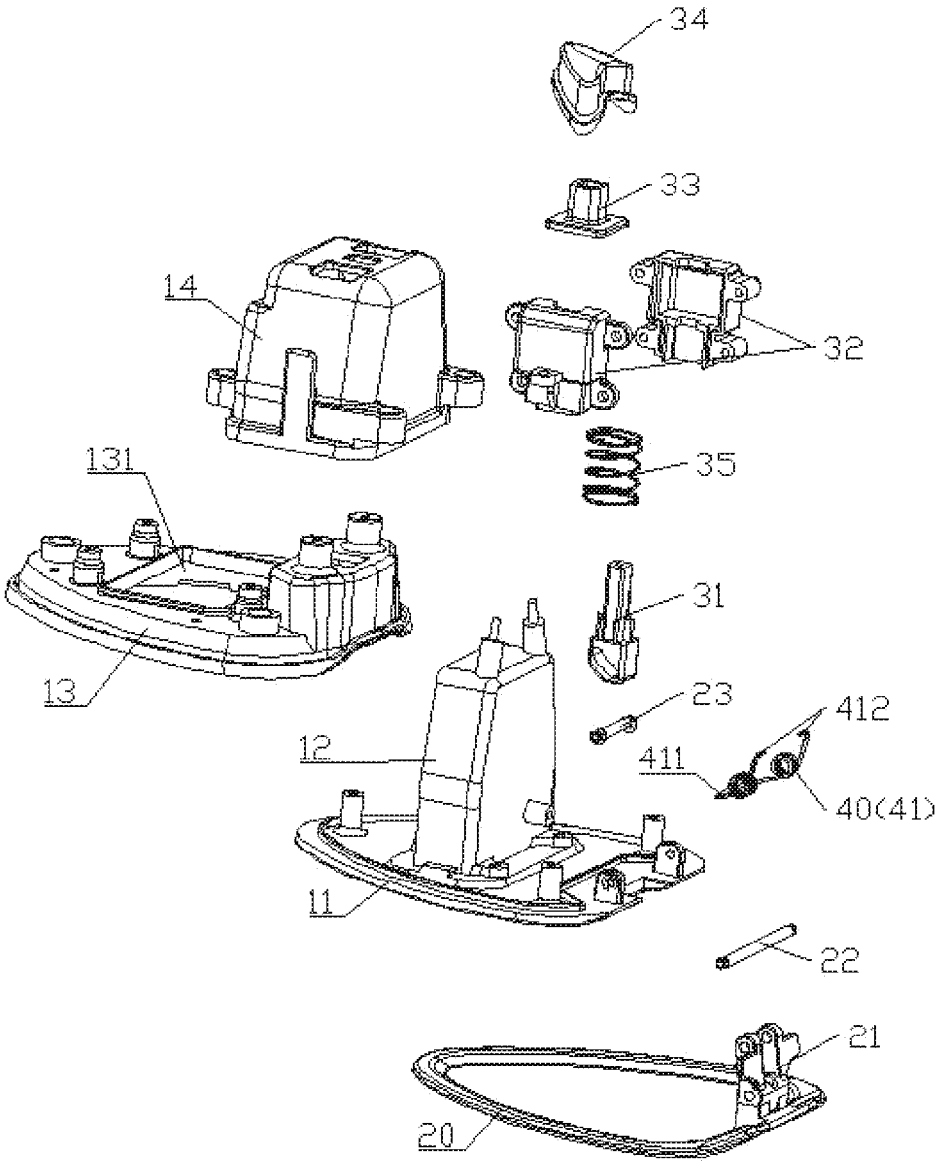
FIG. 5 is a schematic structural exploded view of the steam brush with a clamping and ironing structure in an example.

To further illustrate the examples, the accompanying drawings are provided in the disclosure. These accompanying drawings are a part of the contents disclosed in the disclosure that are mainly used to illustrate the examples, and can be used in conjunction with the related descriptions in the specification to explain the operation principle of the examples. With reference to these contents, those of ordinary skill in the art should be able to understand other possible embodiments and advantages of the disclosure. Components in the drawings are not drawn to scale, and like component symbols are usually used to represent like components.

The disclosure will be further described in conjunction with the accompanying drawings and specific embodiments.

Example I

Referring to FIG. 1 to FIG. 5, this example provides a steam brush with a clamping and ironing structure, including a steam brush body 10 and a plate clamp 20. The steam brush body 10 has an ironing surface 111 and steam outlets 112 provided on the ironing surface 111. A material of the plate clamp 20 is a metal material. The plate clamp 20 is hingedly connected to the steam brush body 10 and forms the clamping and ironing structure with the ironing surface 111.

The plate clamp 20 opens and closes to clamp a garment, so that the garment can be ironed. Moreover, by setting the material of the plate clamp 20 to be the thermally conductive material, when ironing the garment, the plate clamp 20 can obtain heat from the ironing panel (i.e., the component forming the ironing surface 111, which is an electric heating plate 11 described below), such that both sides of the garment clamped between the ironing panel and the plate clamp 20 can be ironed, thereby achieving a better ironing effect.

Specifically, the plate clamp 20 made of the metal material may be the plate clamp 20 made of an elemental metal material, such as copper, aluminum, iron or steel, or the plate clamp 20 made of a metal alloy material, such as aluminum alloy, copper alloy or powder metallurgy.

Preferably, in this example, the plate clamp 20 is made of an aluminum alloy material with an anodized surface, or a ceramic-coated aluminum alloy material. By using the aluminum alloy material on the premise of satisfying the thermal conductivity, the weight can be reduced, and moreover, the anodization of the surface or the arrangement of the ceramic coating can improve the wear resistance of the aluminum alloy material and improve the smoothness.

The steam brush body 10 is provided with a driving portion 30 and an elastic return member 40. The driving portion 30 acts on the plate clamp 20 to drive the plate clamp 20 to open. The elastic return member 40 acts on the plate clamp 20 to drive the plate clamp 20 to close. The user may drive the plate clamp 20 to open by means of the driving portion 30. Then, when the user releases the driving portion 30, the plate clamp 20 loses the driving of the driving portion 30 and closes again under the action of the elastic return member 40, such that the garment is clamped.

Specifically, the plate clamp 20 is provided with a connecting arm 21. In this example, the connecting arm 21 is fixed to the plate clamp 20 by means of assembly. The connecting arm 21 is inserted into the steam brush body 10 via the ironing surface 111, and the connecting arm 21 is hingedly connected to the steam brush body 10 by means of a hinge shaft 22, thereby realizing a hinged connection of the plate clamp 20. Both the driving portion 30 and the elastic return member 40 act on the connecting arm 21. With this arrangement, the hinged connection of the plate clamp 20, the cooperation with the elastic return member 40, and the cooperation structure with the driving portion 30 are all integrated in the steam brush body 10, thereby realizing hidden design and making the appearance more concise and beautiful.

Specifically, in this example, the elastic return member 40 is a double torsion spring 41, and torsion spring sections at two ends of the double torsion spring 41 are respectively sleeved on two ends of the hinge shaft 22. A middle arm 411 and end arms 412 of the double torsion spring 41 respectively abut against the steam brush body 10 and the connecting arm 21 to drive the plate clamp 20 to close. When the plate clamp 20 opens, the double torsion spring 41 is compressed to accumulate energy. After external force is removed from the plate clamp 20, the double torsion spring 41 returns to its original shape and drives the plate clamp 20 to close. With the structure of the double torsion spring 41, the stress is uniform, and the connecting structure is simple. Of course, in other examples, the elastic return member 40 may also be replaced with another elastic member capable of returning to its original shape because of elasticity.

The driving portion 30 is a press assembly, and a press of the press assembly drives the connecting arm 21 to swing with the hinge shaft 22 as a pivot, thereby driving the plate clamp 20 to open. The driving by means of pressing is simple to operate.

Specifically, the press assembly includes a press member 34, a slider 31, and a slider housing 32. The slider housing 32 is fixed to the steam brush body 10. Specifically, the slider housing 32 is formed by splicing a left half housing and a right half housing. The slider 31 is slidable up and down and is assembled on the slider housing 32. A bottom of the slider 31 is provided with an inclined elongated hole 311. The connecting arm 21 is assembled with a slider rotating shaft 23. The slider rotating shaft 23 runs through the inclined elongated hole 311. The press member 34 is connected to a top of the slider 31. The downward press of the press member 34 drives the slider 31 to move downward, thereby driving the connecting arm 21 to swing with the hinge shaft 22 as the pivot.

Further, the press assembly further includes a spring 35 and a spring top cap 33. The spring top cap 33 is fixed to the top of slider 31, and the press member 34 is assembled on the spring top cap 33 so as to be connected to the top of the slider 31. The spring 35 acts on the spring top cap 33 to drive the slider 31 connected thereto, the spring top cap 33 and the press member 34 to move to their original positions, getting ready for the next press. The spring 35 and the spring top cap 33 are adopted to allow the slider 31 and the press member 34 to return to their original positions more stably. Of course, in other examples, the spring 35 and the spring top cap 33 may not be adopted, and the press assembly may return under the driving of the elastic return member 40.

Specifically, the slider housing 32 and the spring top cap 33 are made of a heat insulation material that can isolate heat transferred from the plate clamp 20.

The steam brush body 10 includes an electric heating plate 11, an insulation base 13, and a heat insulation shield 14. A bottom surface of the electric heating plate 11 is the ironing surface 111, which is the ironing panel of the electric heating plate 11. The steam outlets 112 are provided on the electric heating plate 11. The electric heating plate 11 is provided with a steam jet 12 communicated with the steam outlets 112. The insulation base 13 is a heat insulation base board, which, for example, may be made of a heat-resistant plastic material. The insulation base 13 covers the electric heating plate 11 and is provided with an avoidance window 131 for avoiding the steam jet 12. The slider housing 32 of the press assembly is assembled on the insulation base 13. The heat insulation shield 14 covers the steam jet 12 and is fixed on the insulation base 13, which performs a good heat insulation function. By adopting the above structure, the steam brush body 10 is reasonable in structural layout. Of course, in other examples, the structure of the steam brush body 10 is not limited thereto.

An outer edge of the ironing surface 111 of the steam brush body 10 is depressed inward to form a depression 113. Specifically, the ironing surface 111 of the steam brush body 10 is similar to a triangular plane, and the depression 113 is similar to a closed triangular structure. The depression 113 and the ironing surface 111 are connected through an inclined transition surface 114. The plate clamp 20 is a frame structure with a hollowed middle part, which is specifically a triangular frame structure. When in a closed position, the plate clamp 20 is accommodated in the depression 113. After the garment is clamped, the garment can fit tightly on the ironing surface 111. An inner wall of the plate clamp 20 is an inclined inner wall 201 corresponding to the inclined transition surface 114. With this arrangement, the inclined transition surface 114 and the inclined inner wall 201 form an inclined channel, through which the garment can slide smoothly when ironing the garment. Besides, after the plate clamp closes, the surface of the steam panel is so smooth that it can iron the garment like an ordinary steam brush.

Figure 6:
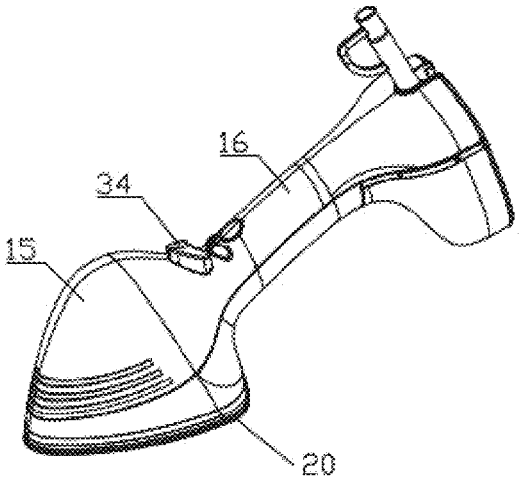
FIG. 6 is a schematic view showing the appearance of the steam brush with a clamping and ironing structure after assembly of a housing in an example.

Referring to FIG. 6, the steam brush body 10 includes a housing 15. Specifically, the housing 15 has a handle 16. The housing 15 covers the insulation base 13, the heat insulation shield 14, and other structures. The electric heating plate 11 is exposed outside the bottom of the housing 15 to cooperate with the plate clamp 20. The press member 34 is arranged at a top of the housing 15 away from the plate clamp 20. In operation, the operator presses the press member 34 down from the top of the housing 15, thereby driving the plate clamp 20 to open.

This example further provides a steaming ironing machine, including at least the steam brush with a clamping and ironing structure described above.

Example II

This example provides a steam brush with a clamping and ironing structure, which has substantially the same structure as the steam brush with a clamping and ironing structure provided in Example I, except that: in Example I, the plate clamp 20 is made of a metal thermally conductive material, but in this example, the plate clamp 20 is made of a nonmetal thermally conductive material, such as plastic and graphite with good high-temperature resistance and thermal conductivity. The steam brush in this structure can also iron both sides of the garment. Compared with the metal thermally conductive material, the use of the nonmetal thermally conductive material may have the problems of poor hardness or high cost. The plate clamp is preferably made of a metal thermally conductive material.

Although the disclosure has been specifically shown and described in connection with the preferred embodiments, it should be understood by those skilled in the art that various changes in form and details can be made without departing from the spirit and scope of the disclosure as defined by the appended claims, and shall all fall within the protection scope of the disclosure.

The invention claimed is:

1. A steam brush with a clamping and ironing structure, comprising a steam brush body and a plate clamp, the steam brush body having an ironing surface and steam outlets provided on the ironing surface; wherein the plate clamp is hingedly connected to the steam brush body and forms the clamping and ironing structure with the ironing surface, and a material of the plate clamp is a thermally conductive material;

the plate clamp is provided with a connecting arm, the connecting arm is inserted into the steam brush body via the ironing surface, and the connecting arm is hingedly connected to the steam brush body by means of a hinge shaft, thereby realizing a hinged connection of the plate clamp;

the steam brush body is provided with a driving portion, the driving portion is a press assembly provided with a press member, the driving portion acts on the connecting arm, and a downward press of the press member drives the connecting arm to swing with the hinge shaft as a pivot, thereby driving the plate clamp to open;

wherein the steam brush body is further provided with an elastic return member, torsion spring sections of the elastic return member are sleeved on the hinge shaft, and the elastic return member acts on the connecting arm of the plate clamp to drive the plate clamp to close; and wherein the press assembly further comprises a slider and a slider housing, the slider housing is fixed on the steam brush body, the slider is slidable up and down and is assembled on the slider housing, a bottom of the slider is provided with an inclined elongated hole, the connecting arm is assembled with a slider rotating shaft, the slider rotating shaft runs through the inclined elongated hole, the press member is connected to a top of the slider, and the downward press of the press member drives the slider to move downward, thereby driving the connecting arm to swing with the hinge shaft as the pivot.

2. The steam brush with the clamping and ironing structure according to claim 1, wherein the material of the plate clamp is a metal material.

3. The steam brush with the clamping and ironing structure according to claim 2, wherein the metal material of the plate clamp is aluminum or aluminum alloy or stainless steel or iron or powder metallurgy.

4. The steam brush with the clamping and ironing structure according to claim 1, wherein the elastic return member is a double torsion spring, the torsion spring sections at two ends of the double torsion spring are respectively sleeved on two ends of the hinge shaft, and a middle arm and end arms of the double torsion spring respectively abut against the steam brush body and the connecting arm to drive the plate clamp to close.

5. The steam brush with the clamping and ironing structure according to claim 1, wherein the steam brush body comprises a housing, and the press member is arranged at a top of the housing away from the plate clamp.

6. The steam brush with the clamping and ironing structure according to claim 2, wherein the steam brush body comprises an electric heating plate, an insulation base and a heat insulation shield, a bottom surface of the electric heating plate is the ironing surface, the steam outlets are provided on the electric heating plate, the electric heating plate is provided with a steam jet communicated with the steam outlets, the insulation base is a heat insulation base board, the insulation base covers the electric heating plate and is provided with an avoidance window for avoiding the steam jet, and the heat insulation shield covers the steam jet and is fixed on the insulation base.

7. The steam brush with the clamping and ironing structure according to claim 2, wherein an outer edge of the ironing surface of the steam brush body is depressed inward to form a depression, the depression and the ironing surface are connected through an inclined transition surface, the plate clamp is a frame structure with a hollowed middle part, and when in a closed position, the plate clamp is accommodated in the depression and an inner wall of the plate clamp is an inclined inner wall corresponding to the inclined transition surface.

8. A steaming ironing machine, comprising at least the steam brush with the clamping and ironing structure according to claim 1.

9. The steaming ironing machine according to according to claim 8, wherein the material of the plate clamp is a metal material.

10. The steaming ironing machine according to claim 9, wherein the metal material of the plate clamp is aluminum or aluminum alloy or stainless steel or iron or powder metallurgy.

11. The steaming ironing machine according to claim 8, wherein the elastic return member is a double torsion spring, and the torsion spring sections at two ends of the double torsion spring are respectively sleeved on two ends of the hinge shaft, and a middle arm and end arms of the double torsion spring respectively abut against the steam brush body and the connecting arm to drive the plate clamp to close.

12. The steaming ironing machine according to claim 8, wherein the steam brush body comprises a housing, and the press member is arranged at a top of the housing away from the plate clamp.

13. The steaming ironing machine according to claim 9, wherein the steam brush body comprises an electric heating plate, an insulation base and a heat insulation shield, a bottom surface of the electric heating plate is the ironing surface, the steam outlets are provided on the electric heating plate, the electric heating plate is provided with a steam jet communicated with the steam outlets, the insulation base is a heat insulation base board, the insulation base covers the electric heating plate and is provided with an avoidance window for avoiding the steam jet, and the heat insulation shield covers the steam jet and is fixed on the insulation base.

14. The steaming ironing machine according to claim 9, wherein an outer edge of the ironing surface of the steam brush body is depressed inward to form a depression, the depression and the ironing surface are connected through an inclined transition surface, the plate clamp is a frame structure with a hollowed middle part, and when in a closed position, the plate clamp is accommodated in the depression and an inner wall of the plate clamp is an inclined inner wall corresponding to the inclined transition surface.

15. A steam brush with a clamping and ironing structure, comprising a steam brush body and a plate clamp, the steam brush body having an ironing surface and steam outlets provided on the ironing surface; wherein the plate clamp is hingedly connected to the steam brush body and forms the clamping and ironing structure with the ironing surface, and a material of the plate clamp is a thermally conductive material;

the plate clamp is provided with a connecting arm, the connecting arm is inserted into the steam brush body via the ironing surface, and the connecting arm is hingedly connected to the steam brush body by means of a hinge shaft, thereby realizing a hinged connection of the plate clamp;

the steam brush body is provided with a driving portion, the driving portion is a press assembly provided with a press member, the driving portion acts on the connecting arm, and a downward press of the press member drives the connecting arm to swing with the hinge shaft as a pivot, thereby driving the plate clamp to open;

wherein an outer edge of the ironing surface of the steam brush body is depressed inward to form a depression, the depression and the ironing surface are connected through an inclined transition surface, the plate clamp is a frame structure with a hollowed middle part, and when in a closed position, the plate clamp is accommodated in the depression and an inner wall of the plate clamp is an inclined inner wall corresponding to the inclined transition surface; and wherein the press assembly further comprises a slider and a slider housing, the slider housing is fixed on the steam brush body, the slider is slidable up and down and is assembled on the slider housing, a bottom of the slider is provided with an inclined elongated hole, the connecting arm is assembled with a slider rotating shaft, the slider rotating shaft runs through the inclined elongated hole, the press member is connected to a top of the slider, and the downward press of the press member drives the slider to move downward, thereby driving the connecting arm to swing with the hinge shaft as the pivot.

16. A steaming ironing machine, comprising at least the steam brush with the clamping and ironing structure according to claim 15.

* * * * *